US007165437B2

(12) United States Patent
Shin et al.

(10) Patent No.: US 7,165,437 B2
(45) Date of Patent: Jan. 23, 2007

(54) MECHANICAL PRESS DEVICE

(75) Inventors: Hyun Oh Shin, Seoul (KR); Susumu Kuroiwa, Takasaki (JP); Yoshimasa Yajima, Takasaki (JP)

(73) Assignees: Kojima Iron Works Co., Ltd. (JP); Hyundai Motor Company (KR)

( * ) Notice: Subject to any disclaimer, the term of this patent is extended or adjusted under 35 U.S.C. 154(b) by 0 days.

(21) Appl. No.: 10/524,804

(22) PCT Filed: Aug. 24, 2004

(86) PCT No.: PCT/JP2004/012126

§ 371 (c)(1),
(2), (4) Date: Dec. 12, 2005

(87) PCT Pub. No.: WO2005/065927

PCT Pub. Date: Jul. 21, 2005

(65) Prior Publication Data

US 2006/0101891 A1 May 18, 2006

(30) Foreign Application Priority Data

Jan. 8, 2004 (JP) ..... 2004-003083

(51) Int. Cl.
*B21D 43/02* (2006.01)

(52) U.S. Cl. ..... 72/417; 72/453.03; 100/269.06

(58) Field of Classification Search ..... 72/453.05, 72/453.03, 417, 311, 308, 350, 351; 100/270, 100/269.06
See application file for complete search history.

(56) References Cited

U.S. PATENT DOCUMENTS 6,520,075 B1 * 2/2003 Shinoda et al. ..... 100/214

FOREIGN PATENT DOCUMENTS

| | | | |
|---|---|---|---|
| DE | 3935011 A | * | 8/1990 |
| JP | 08-103827 | | 4/1996 |
| JP | 2001-96397 A | * | 4/2001 |

* cited by examiner

*Primary Examiner*—Lowell A. Larson
*Assistant Examiner*—Debra Wolfe
(74) *Attorney, Agent, or Firm*—Cook, Alex, McFarron, Manzo, Cummings & Mehler, Ltd.

(57) ABSTRACT

The invention provides a mechanical press apparatus for both single and double uses which can press mold a large-sized blank at a high pressure by employing a single action use aspect while being of a double action type. In a mechanical press apparatus provided with a drive portion (14) which moves upward and downward an outer slide (8) and an inner slide (9) arranged in an inner side of the outer slide at a predetermined timing, an elevating plate (10) is fixed to a lower end surface of the outer slide (8) so as to oppose to a lower surface of the inner slide (9), and the lower surface is provided with an upper die (7) and a lower die (3) positioned at a lower surface thereof so as to press. Further, an upper surface portion of the elevating plate (10) is provided with a first hydraulic cylinder (11) contracted by a pressing force at a time when the inner slide (9) moves downward. Further, a second hydraulic cylinder (12) is provided between the outer slide (8) and the drive portion (14) so as to be expanded working with a pressure of a pressurized fluid supplied from the first hydraulic cylinder (11) at a time when the first hydraulic cylinder (11) is contracted by the pressing force of the inner slide (9), thereby pressing the outer slide (8) to a lower side.

8 Claims, 8 Drawing Sheets

MECHANICAL PRESS DEVICE

TECHNICAL FIELD

The present invention relates to a mechanical press apparatus, and more particularly to a mechanical press apparatus which can be used in a single action aspect while being of a double action type.

BACKGROUND OF THE INVENTION

A press apparatus served for a drawing process of a steel plate is conventionally classified broadly into a hydraulic press apparatus using a hydraulic pressure, and a mechanical press apparatus on the basis of a mechanical drive force by a pressure generating mechanism, however, they are classified into a single action type and a double action type on the basis of a motion type of a slide. Further, the mechanical press apparatus is classified into a crank press, a knuckle press, a link press, a friction press and the like on the basis of a drive mechanism of the slide.

Among the structures mentioned above, the double action type mechanical press apparatus is structured such that an outer slide and an inner slide provided in an inner side of the outer slide are independently moved upward and downward by a drive portion, the outer slide moves downward prior to the inner slide at a time of pressing a blank, an outer die attached thereto presses a peripheral edge portion of the blank, and a draw molding or the like of the blank is next performed by the downward movement of the inner slide (refer, for example, to Japanese Unexamined Patent Publication No. 8-103827).

As mentioned above, in the conventional mechanical press apparatus on the basis of the double action type, since the outer slide presses the blank prior to the inner slide, there is an advantage that a deep drawing of the blank can be stably and well achieved in comparison with the single action type.

However, the conventional mechanical press apparatus on the basis of the double action type requires two molds for each of upper and lower molds, such as an outer die and an inner die (a punch) serving as the upper mold, and a blank holder corresponding to the outer die and a cavity corresponding to the inner die serving as the lower mold, and a structure of the drive portion is complex in comparison with the single action type. Accordingly, there is a disadvantage that a high cost is required.

Further, the conventional mechanical press apparatus on the basis of the double action type is generally placed at the head of a tandem line in order to suit for a deep drawing, and the single action type generally forms the blank in a convex shape. On the contrary, since the double action type performs a concave shape, it is necessary to reverse upper and lower surfaces of the blank by equipping a turn-over device between the double action type and the single action type. Accordingly, there is a problem that a productivity of the press molded product is deteriorated.

In particular, in the conventional mechanical press apparatus on the basis of the double action type, since a drive force distributed to the outer slide and the inner slide is determined by the structure of the drive portion, a pressing capacity of the outer slide and the inner slide can not be changed in correspondence to a material and a thickness of the blank. Further, if the inner die is enlarged, the inner die is interfered with the outer die. Accordingly, a product pressed thereby is limited to a magnitude of an inner side of the outer slide.

Accordingly, in recent years, the single action type press apparatus is mainly employed for the purpose of corresponding to an increase in size of the press molded product such as a motor vehicle body or the like and improving a productivity, and the mechanical press apparatus which is of the double action type, has a small pressing capacity and is hard to be modified for increasing the capacity is not used very much, and is under an actual condition of being anxious about a countermeasure thereof.

The present invention is made by taking the circumstances mentioned above into consideration, and an object of the present invention is to make it possible to preferably press mold a large-sized blank at a high pressure by employing a single action use aspect while being of a double action type.

SUMMARY OF THE INVENTION

In order to achieve the object mentioned above, in accordance with the present invention, there is provided a mechanical press apparatus provided with a drive portion which moves upward and downward an outer slide and an inner slide arranged in an inner side of the outer slide at a predetermined timing, comprising:

an elevating plate fixed to a lower end surface of the outer slide so as to oppose to a lower surface of the inner slide;

an upper die (an upper mold) fixed to a lower surface of the elevating plate;

a lower die (a lower mold) positioned at a lower surface of an upward and downward movement of the upper die so as to press;

a first hydraulic cylinder provided in an upper surface portion of the elevating plate and contracted by a pressing force at a time when the inner slide moves downward; and a second hydraulic cylinder interposed between the outer slide and the drive portion and expanded working with a pressure of a pressurized fluid supplied from the first hydraulic cylinder at a time when the first hydraulic cylinder is contracted by the pressing force of the inner slide, thereby pressing the outer slide to a lower side.

In this case, it is preferable that each of the first hydraulic cylinder and the second hydraulic cylinder is of a single rod type having an expansion rod integrally provided with a piston portion which is reciprocated in a longitudinal direction in an inner portion of a hollow and sealed cylinder barrel so as to expand and compress a fluid in an inner portion, and a rod portion which is extended from the piston portion to an outer portion of the cylinder barrel, and of a double action type having a primary port supplying and discharging the expanded and compressed fluid to a side of the piston portion of the expansion rod and a secondary port supplying and discharging the fluid in a side of the rod portion of the expansion rod in the cylinder barrel, and the cylinder barrels of the first hydraulic cylinder and the second hydraulic cylinder are connected in the primary ports to each other via a consecutive passage, and work with each other such that the pressurized fluid flows into the second hydraulic cylinder via the consecutive passage at a time when the first hydraulic cylinder is contracted, thereby expanding the expansion rod.

Further, it is preferable that a rate A1/A2 between a pressure receiving area A1 of the first hydraulic cylinder (the piston portion) and a pressure receiving area A2 of the second hydraulic cylinder (the piston portion) is set to be equal to a rate P1/P2 between a pressing capacity P1 of the inner slide and a pressing capacity P2 of the outer slide.

Further, it is preferable that a first pipe line for supplying the pressurized fluid having a predetermined pressure from a pressure source is connected to an area of the consecutive passage connecting the primary ports of the first hydraulic cylinder and the second hydraulic cylinder to each other, a second pipe line for supplying the pressurized fluid having a higher pressure than that of the pressurized fluid supplied to the first pipe line from the pressure source so as to return to the state before being communicated is connected to the secondary port of the second hydraulic cylinder, and the secondary port of the first hydraulic cylinder is provided so as to supply and discharge an air serving as the fluid in correspondence to the motion thereof.

Further, it is preferable that the first hydraulic cylinder is provided so as to be actuated only by the primary port with canceling the secondary port.

Further, it is preferable that a die set portion for coupling the upper die is provided in the lower surface of the elevating plate.

BRIEF DESCRIPTION OF THE DRAWINGS

FIG. 1 is a schematic view showing an embodiment of a mechanical press apparatus in accordance with the present invention.

FIG. 2 is a side elevational view showing an example of a structure of a drive portion shown in FIG. 1 as seen by a vertical cross section.

FIG. 3 is a front elevational view showing an example of the structure of the drive portion shown in FIG. 1 as seen by partly cutting along a front surface.

FIG. 4 is a cross sectional view showing a cross section along a line X—X shown in FIG. 3.

FIG. 5 is a schematic view showing a mounting portion of an upper die shown in FIG. 1.

FIG. 6 is a circuit diagram showing an embodiment of a hydraulic circuit executing a pressure control within first and second hydraulic cylinders shown in FIG. 5.

FIGS. 7A–7D are schematic views explaining a working operation of a blank by the mechanical press apparatus shown in FIG. 1.

FIG. 8 is a cycle curve of an outer slide and an inner slide.

DETAILED DESCRIPTION OF THE PRESENTLY PREFERRED EMBODIMENTS

Figure 1:
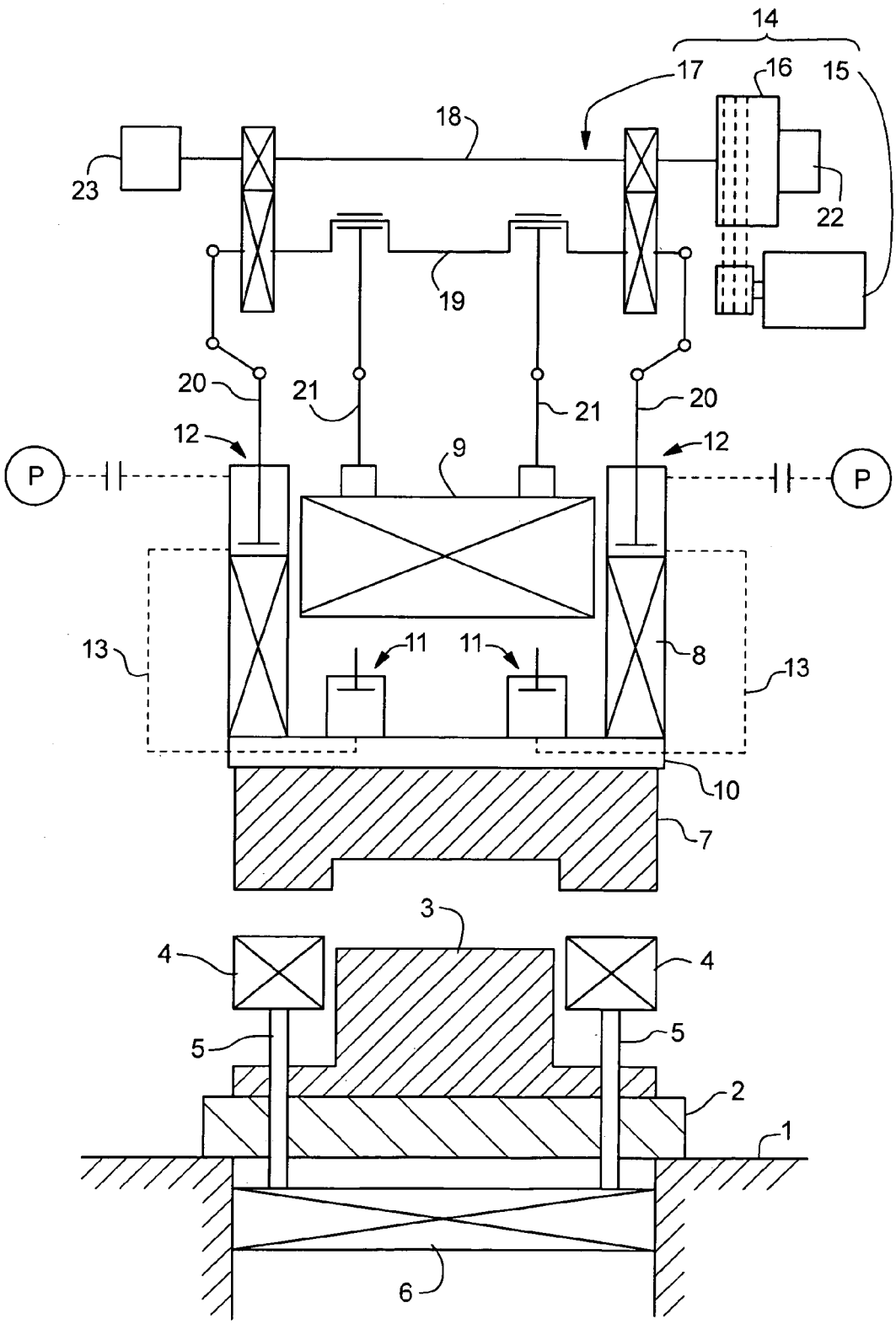
[FIG. 1]

Descriptions will be in detail given below of embodiments of mechanical press apparatus in accordance with the present invention with reference to the accompanying drawings. First, FIG. 1 is a schematic view showing the embodiment of the mechanical press apparatus in accordance with the present invention. In FIG. 1, reference numeral 1 denotes a bed, reference numeral 2 denotes a bolster fixed on the bed, reference numeral 3 denotes a lower die mounted on the bolster 2, and reference numeral 4 denotes a frame-like blank holder arranged in an outer side of the lower die 3. The blank holder 4 is supported by a cushion pin 5 passing through the bolster 2, and the cushion pin 5 is supported so as to freely elevate by a die cushion 6 arranged within the bed 1. In this case, the blank holder 4, the cushion pin 5 and the die cushion 6 can be omitted as occasion demands.

On the other hand, reference numeral 7 denotes an upper die corresponding to the lower die 3, and reference numeral 8 denotes a frame-like outer slide elevating the upper die 7. An inner slide 9 is provided in an inner side of the outer slide 8, and the slides 8 and 9 are suspended below a crank shaft 19 mentioned below by a balance cylinder (not shown) so as to freely elevate. In particular, an elevating plate 10 closing a lower opening portion of the outer slide 8 is fixed to the outer slide 8, and the structure is made such that the upper die 7 is mounted to a lower surface of the elevating plate 10. In other words, the upper die 7 (an upper mold) is moved downward to the lower die (a lower mold) positioned at an upward and downward moving lower surface (a top surface of the bolster 2) so as to be fixed thereto, and is formed as a single action type mold structure by pinching a blank W (refer to FIG. 7) therebetween. Therefore, in accordance with the present embodiment, since it is possible to form by one upper mold and one lower mold comprising the upper die 7 serving as the upper mold and the lower die 3 serving as the lower mold, a metal mold structure is simple and a cost can be reduced in the same manner as the single action type. Further, in accordance with the present embodiment, since the turn-over device is not required even if the mechanical press apparatus in accordance with the present invention is placed at the head of the tandem line on the basis of the single action type structure forming the blank W in a convex shape, a productivity of the press molded product can be improved. Further, in accordance with the present embodiment, since it is possible to form by one upper mold and one lower mold as mentioned above, the upper and lower molds are not separated into the inner die and the outer die as in the double action type and are not interfered with each other, whereby it is possible to prevent the press molded product from being limited to the magnitude of the inner side of the outer slide. On the other hand, a first hydraulic cylinder 11 is provided in the upper surface portion of the elevating plate 10, a second hydraulic cylinder 12 is interposed in an upper end surface of the outer slide 8 with respect to a drive portion 14 mentioned below, and the structure is made such that both the hydraulic cylinders 11 and 12 are connected by a consecutive passage 13 so as to be alternately contracted and expanded in an interlocking manner on the basis of the supply and the discharge of the pressurized fluid. In this case, in the present embodiment, four hydraulic cylinders 11 and 12 are provided respectively. In other words, the present embodiment is formed as the mechanical press structure for both the single and double actions which can achieve the double action type motion while having the single action type mold structure, and can press mold even the large-sized blank W such as the motor vehicle body or the like at a high pressure.

In this case, reference numeral 14 denotes a drive portion moving upward and downward the outer slide 8 and the inner slide 9 at a predetermined timing. The drive portion 14 is constituted by a motor 15 (an electric motor) forming a drive source, a flywheel 16 storing a drive force, and a transmission mechanism 17 converting a rotational movement of the flywheel 16 into a reciprocating linear movement of the outer slide 8 and the inner slide 9. In the present embodiment, the transmission mechanism 17 is a broad crank mechanism including a link, and is constituted by a main shaft 18 rotationally driven by the flywheel 16, a crank shaft 19 working with the main shaft, an outer rod 20 for connecting the crank shaft 19 to the outer slide 8, and an inner rod 21 for connecting the crank shaft 19 to the inner slide 9. In this case, reference numeral 22 denotes a clutch provided in one end side of the main shaft 18, and reference numeral 23 denotes a brake apparatus provided in the other end side of the main shaft 18.

Further, in accordance with the mechanical press apparatus mentioned above, when the outer slide 8 and the inner slide 9 are moved downward on the basis of an actuation of the drive portion 14, and the outer slide 8 is moved downward to a predetermined position (a substantial bottom dead center where the upper die 7 is in contact with the blank on the blank holder 4), the other second hydraulic cylinder 12 is expanded so as to press the outer slide 8 to a lower side on the basis of the compression of the first hydraulic cylinder 11 caused by the pressing force of the inner slide 9, at the same time when the inner slide 9 presses the elevating plate 10 to a lower side while compressing the first hydraulic cylinder 11.

Figure 2:
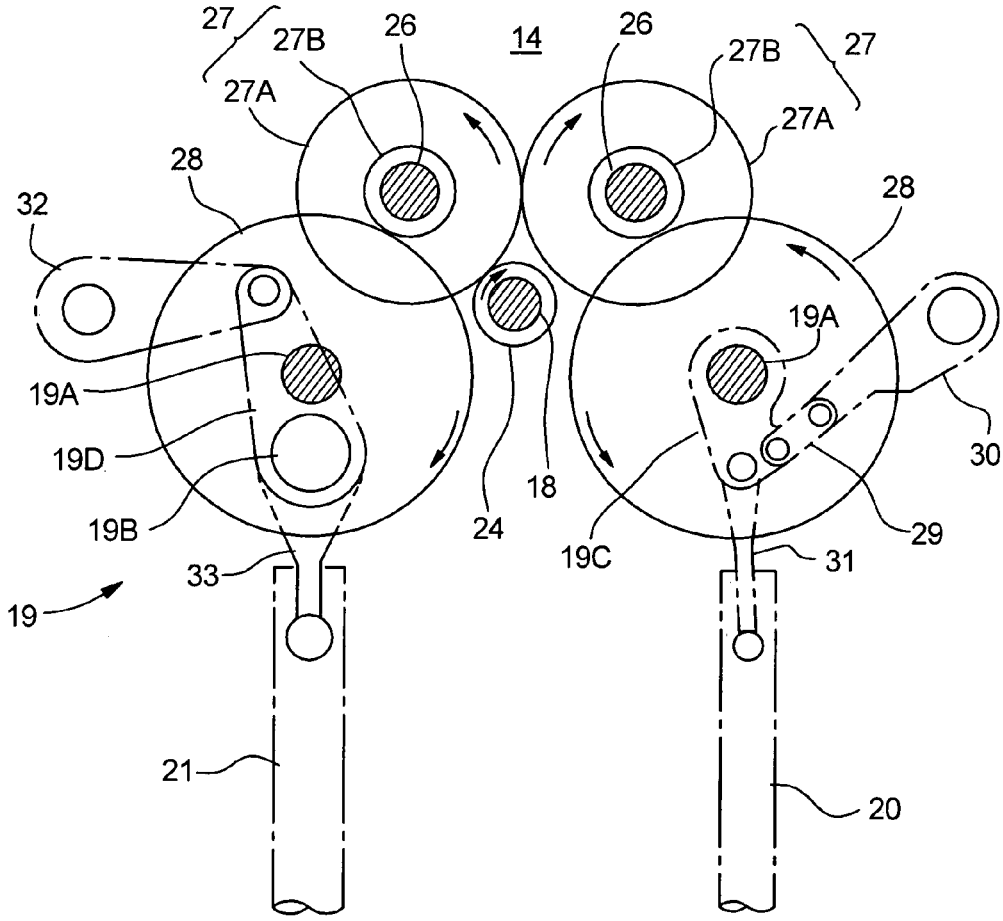
[FIG. 2]
Figure 3:
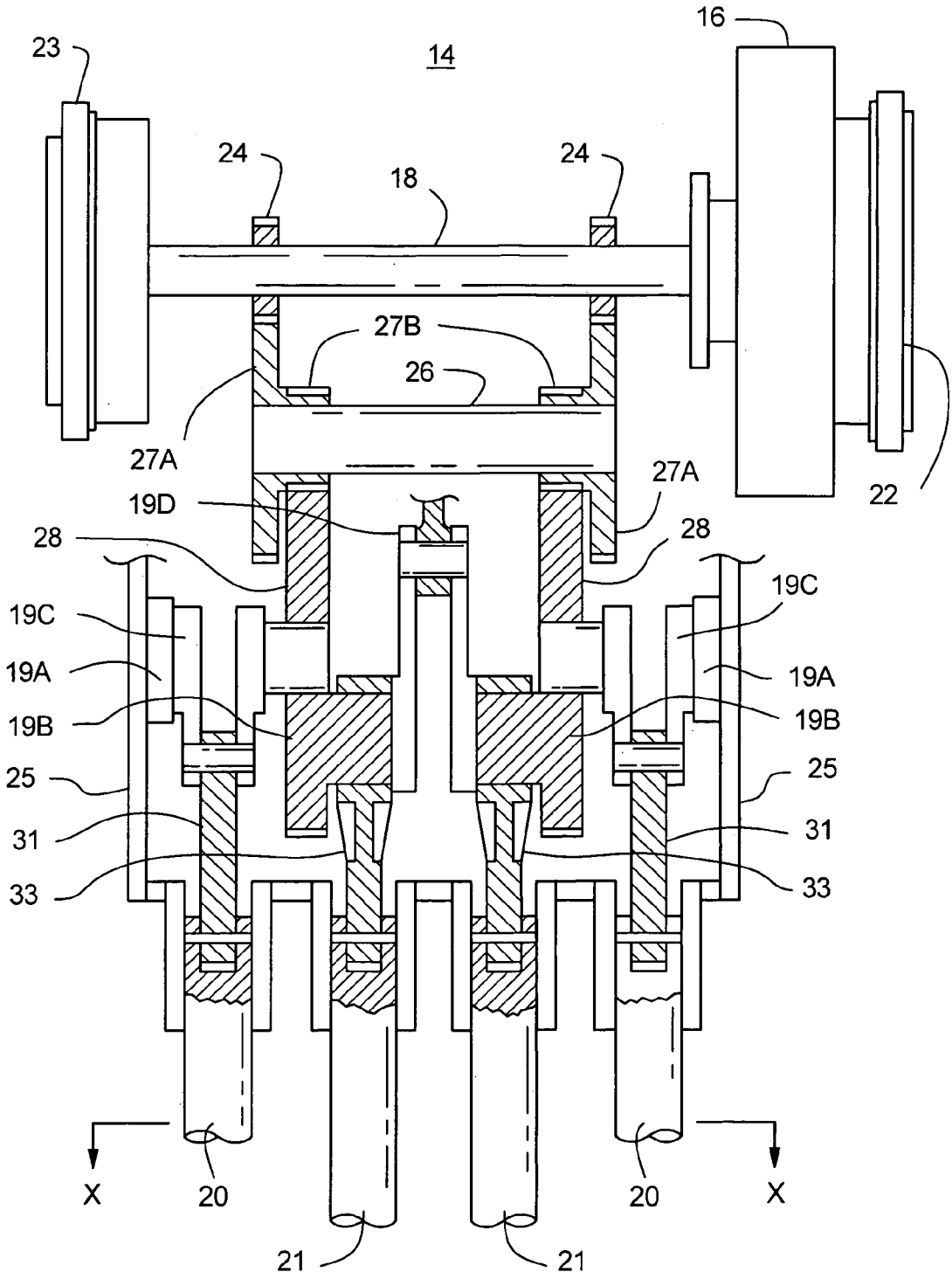
[FIG. 3]

Next, FIG. 2 is a side elevational view showing an example of a structure of the drive portion 14 shown in FIG. 1 as seen by a vertical cross section, and FIG. 3 is a front elevational view showing an example of the structure of the drive portion 14 shown in FIG. 1 as seen by partly notching along a front surface. A description will be given in detail of the example of the structure (the structure which is not shown in FIG. 1) of the drive portion 14 with reference to FIGS. 2 and 3. A pair of pinion gears 24 are fixed to the main shaft 18 so as to leave a predetermined space. Further, a pair of right and left rotary shafts 26 are mounted to an apparatus frame 25 so as to be in parallel to the main shaft 18, and two idle gears 27 of a two-stage structure having a large-diameter portion 27A and a small-diameter portion 27B are fixed to each of both the rotary shafts 26. Among them, the large-diameter portions 27A of the adjacent idle gears 27 are engaged with each other, and the pinion gear 24 is engaged with the large-diameter portion 27A of the idle gear 27 fixed to one rotary shaft 26. Further, two crank shafts 19 are provided in the apparatus frame 25 in a parallel manner along the main shaft 18, and an output gear 28 engaging with the small-diameter portion 27B of the idle gear 27 is mounted to both the crank shaft 19. In this case, the crank shaft 19 is constituted by a crank journal 19A forming a center of rotation of the output gear 28, an eccentric pin 19B formed at an eccentric point, a crank arm 19C mounted to the crank journal 19A, and a crank arm 19D mounted to the eccentric pin 19B. Further, oscillating links 29 and 30 and a connecting rod 31 are connected to the crank arm 19C in an outer side, and a lower end of the connecting rod 31 is joined by pin to an upper end of the outer rod 20. Further, an oscillating link 32 is connected to the crank arm 19D in an inner side, and the inner rod 21 is connected to the eccentric pin 19B via a connecting rod 33.

In accordance with the drive portion 14 (the transmission mechanism) structured as mentioned above, it is possible to move the rods 20 and 21 upward and downward at the predetermined timing on the basis of a difference in the connection aspect of the outer rod 20 and the inner rod 21 with respect to the crank shaft 19.

Figure 4:
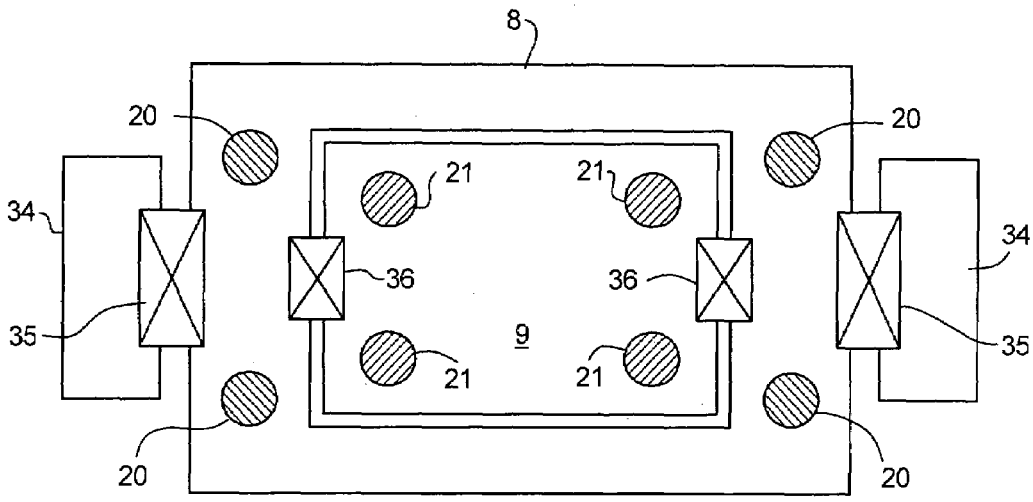
[FIG. 4]

Next, FIG. 4 is a cross sectional view showing a cross section along a line X—X shown in FIG. 3. As is apparent from the drawing, the outer rod 20 is connected to four positions on the upper surface of the outer slide 8, and the inner rod 21 is connected to four positions on the upper surface of the inner slide 9. In this case, in FIG. 4, reference numeral 34 denotes a column. An outer guide 35 (a slide gib) forming a guide for a reciprocating movement of the outer slide 8 is mounted to the column 34, and an inner guide 36 (a slide gib) forming a guide of the inner slide 9 is mounted to an inner side surface of the outer slide 8.

Figure 5:
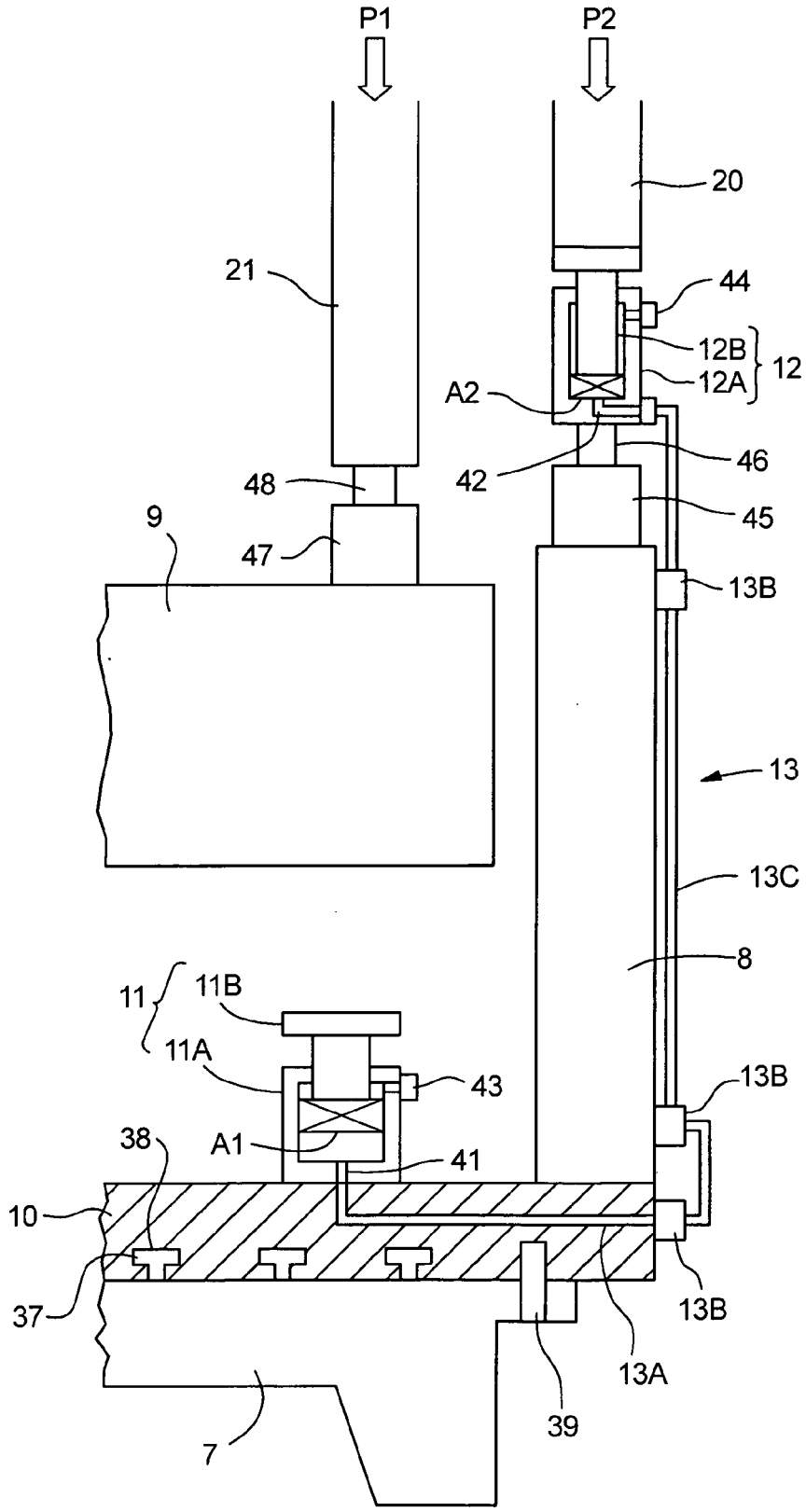
[FIG. 5]

Next, FIG. 5 is a schematic view showing a mounting portion of the upper die 7 shown in FIG. 1. In this FIG. 5, the elevating plate 10 is formed by a thick steel plate which is equal to or larger than an outer periphery of the outer slide 8, and is fixed to the lower end surface of the outer slide 8 by using bolts or the like. Further, plural grooves of T-shaped notch grooves 37 are formed as a die set portion mounting the upper die 7 in the lower surface of the elevating plate 10 in a parallel manner, and the structure is made such that a convex nut 38 mounted to the upper surface of the upper die 7 is fitted to each of the notch grooves 37, and a positioning pin 39 is press fitted to the elevating plate 10 from the upper die 7.

Further, as is apparent from FIG. 5, each of the first hydraulic cylinder 11 and the second hydraulic cylinder 12 is structured as a hydraulic cylinder of a single rod type having an expansion rod 11B or 12B integrally provided with a piston portion which is reciprocated in a longitudinal direction in an inner portion of a hollow and sealed cylinder barrel 11A or 12A so as to expand and compress the fluid in the inner portion, and a rod portion which is extended from the piston portion to an outer portion of the cylinder barrel 11A or 12A, and of a double action type having a primary port 41 or 42 supplying and discharging the expanded and compressed fluid to a side of the piston portion of the expansion rod 11B or 12B and a secondary port 43 or 44 supplying and discharging the fluid in a side of the rod portion of the expansion rod 11B or 12B in the cylinder barrel 11A or 12A. Among them, the cylinder barrel 11A of one first hydraulic cylinder 11 is fixed to the upper surface portion of the elevating plate 10, and an upper end surface (a rod portion) of the expansion rod 11B protruding from the cylinder barrel 11A is opposed to the lower surface of the inner slide 9, and is controlled so as to keep an expansion and contraction state at a time when the pressing force by the inner slide 9 is not applied. However, the structure may be made such that the expansion rod 11B is fixed to the upper surface portion of the elevating plate 10 by setting the cylinder barrel 11A upward. Further, in the present embodiment, the first hydraulic cylinder 11 is structured such that the expansion rod 11B has the piston portion and the rod portion, however, this can be changed to a plunger type.

On the other hand, the cylinder barrel 12A of the second hydraulic cylinder 12 is mounted to the upper end surface of the outer slide 8 via a nut 45 and an adjuster bolt 46 so as to be adjustable in height, and an upper end surface (a rod portion) of the expansion rod 12B protruding from the cylinder barrel 12A is fixed to the outer rod 20. Further, the inner rod 21 is connected to the inner slide 9 via a nut 47 and an adjuster bolt 48. In this case, a height adjustment of the respective slides 8 and 9 by the adjust bolts 46 and 48 is executed before connecting the outer slide 8 and the inner slide 9 to the outer rod 20 and the inner rod 21. In this case, the expansion rod 12B of the second hydraulic cylinder 12 is also formed as an aspect having the piston portion and the rod portion, however, the structure may be made such that the expansion rod 12B is mounted to the outer slide 8 by setting the expansion rod 12B downward and the cylinder barrel 12A is fixed to the outer rod 20.

In this case, in the cylinder barrels 11A and 12A of the first and second hydraulic cylinders 11 and 12 as mentioned above, the primary ports 41 and 42 are connected to each other via the consecutive passage 13 such that when one first hydraulic cylinder 11 is contracted by the pressing force caused by the downward movement of the main slide 9, the other second hydraulic cylinder 12 is expanded so as to press the outer slide 8 to the lower side. In other words, both ends of the consecutive passage 13 are respectively connected to the primary ports 41 and 42 of the first and second hydraulic cylinders 11 and 12, and when one first hydraulic cylinder 11 is contracted, the pressurized fluid (a working fluid) is pushed out from the primary port 41, and flows into the inner portion from the primary port 42 of the other second hydraulic cylinder 12 through the consecutive passage 13 so as to generate the pressure for expanding the expansion rod 12B of the hydraulic cylinder 12 under the contracted state and achieve an interlock.

In this case, the consecutive passage 13 is constituted by an excavation hole 13A formed within the elevating plate 10 and a pipe 13C connected via the block 13B, and the structure is made such that one end of the excavation hole 13A is connected with the primary port 41 of the first hydraulic cylinder 11, and another end of the excavation hole 13A and the primary port 42 of the second hydraulic cylinder 12 are connected by the pipe 13C. Further, a rate A1/A2 between a pressure receiving area A1 of the first hydraulic cylinder 11 (the piston portion) and a pressure receiving area A2 of the second hydraulic cylinder 12 (the piston portion) is set to be equal to a rate P1/P2 between a pressing capacity P1 of the inner slide 9 (a force applied to the inner slide 9 from the inner rod 21) and a pressing capacity P2 of the outer slide 8 (a force applied to the outer slide 8 from the outer rod 20).

For example, in the case that the pressing capacity P1 of the inner slide 9 is 1600 tons (4×400), and the pressing capacity P2 of the outer slide 8 is 800 tons (4×200), the rate A1/A2 between the pressure receiving area A1 of the first hydraulic cylinder 11 and the pressure receiving area A2 of the second hydraulic cylinder 12 is set to 2/1. In accordance with this structure, it is possible to apply the pressing force as large as possible to the outer slide 8 from the above so as to prevent the strain of the elevating plate 10 at a time of pressing the blank, while preventing an overload from being applied to the drive portion 14 (the outer rod 20) from the second hydraulic cylinder 12, whereby it is possible to well executed the press molding by the upper die 7 mounted to the lower surface.

In this case, an internal pressure of the first and second hydraulic cylinders 11 and 12 can be controlled by a pressure control means (a hydraulic apparatus) including the first and second hydraulic cylinders 11 and 12.

Figure 6:
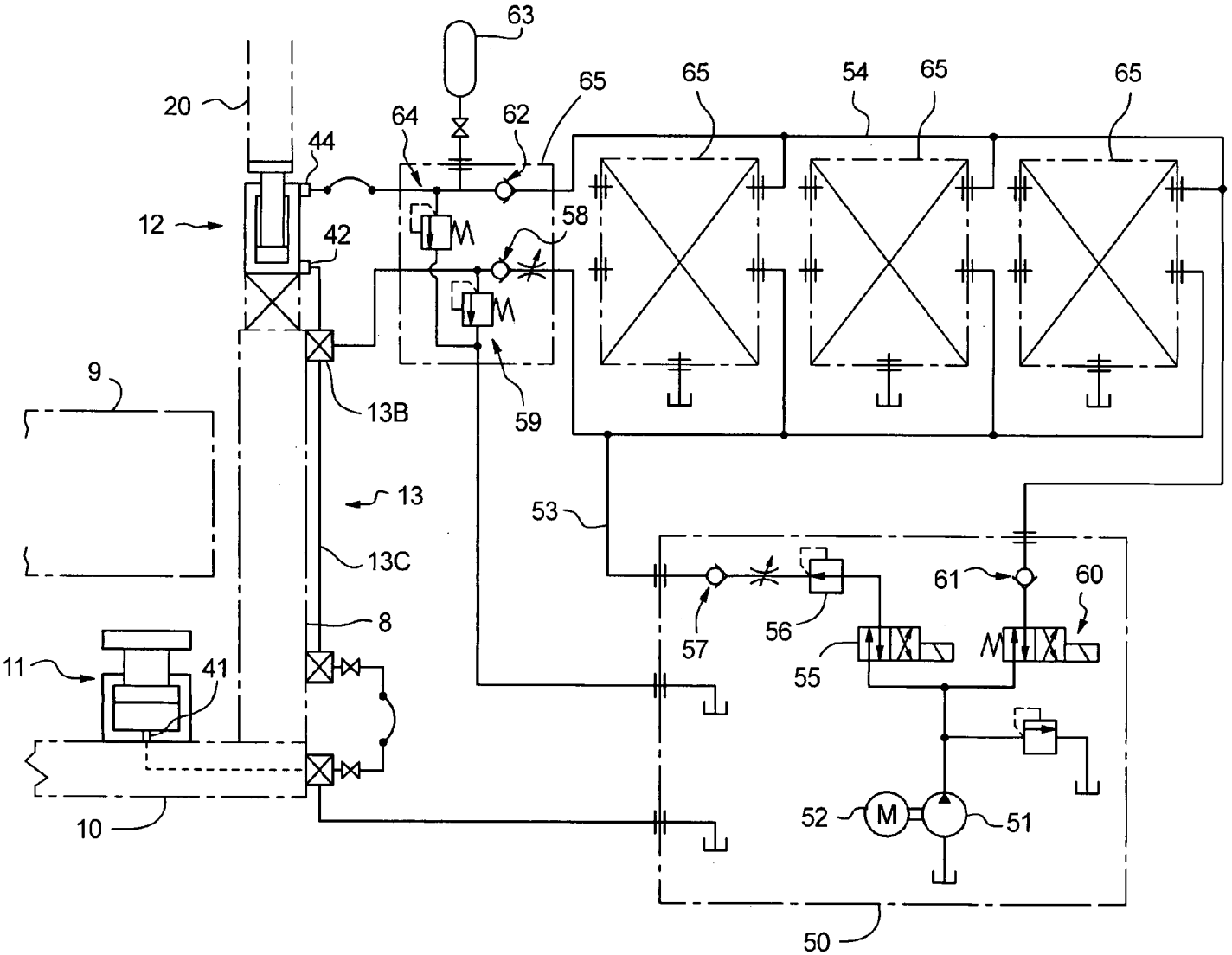
[FIG. 6]

FIG. 6 is a circuit diagram showing an embodiment of a hydraulic circuit for executing a pressure control within the first and second hydraulic cylinders 11 and 12 shown in FIG. 5. In FIG. 6, reference numeral 50 denotes a hydraulic unit. The hydraulic unit 50 in accordance with the present embodiment is provided with a fixed displacement type hydraulic pump 51 serving as the pressure source, and a motor 52 for driving the hydraulic pump 51. Further, the hydraulic pump 51 is connected to an area of the consecutive passage 13 (a block 13B constituting the consecutive passage 13 in the present embodiment) connecting the primary ports 41 and 42 of the first and second hydraulic cylinders 11 and 12 via a pipe line 53 (a first pipe line), and the structure is made such that the pressurized fluid (the working fluid) having a predetermined pressure is supplied into the first and second hydraulic cylinders 11 and 12 from the hydraulic pump 51. Further, the secondary port 44 of the second hydraulic cylinder 12 and the hydraulic pump 51 are connected by a pipe line 54 (a second pipe line), and the structure is made such that the pressurized fluid having a higher pressure than that of the pressurized fluid supplied to the pipe line 53 (the first pipe line) is supplied to the inner portion of the second hydraulic cylinder 12 from the secondary port 44 through the pipe line 54 from the hydraulic pump 51 so as to return to the state before the interlock. Further, the secondary port 43 (refer to FIG. 5) of the first hydraulic cylinder 11 is provided so as to supply and discharge the air serving as the fluid to the side of the rod portion within the cylinder barrel 11A in correspondence to the interlocking motion mentioned above.

In this case, the first hydraulic cylinder 11 is described in detail with respect to the embodiment provided with the primary port 41 and the secondary port 43, however, is not limited to this. For example, the first hydraulic cylinder 11 may be provided so as to be actuated only by the primary port 41 by canceling the secondary port 43.

In this case, an operated directional valve 55, a pressure reducing valve 56, check valves 57 and 58 and a pressure control valve 59 (a relief valve) are interposed in the first pipe line 53 in sequence from an upstream side, and an operated directional valve 60, check valves 61 and 62, an accumulator 63 and a pressure control valve 64 (a relief valve) are interposed in the second pipe line 54 in sequence from an upstream side. Among them, the check valves 58 and 62, the accumulator 63, and the pressure control valves 59 and 64 structure a control unit 65 in correspondence to a set of hydraulic cylinders 11 and 12, however, a working pressure of the pressure control valve 59 in the first pipe line 53 in the control unit 65 is set higher than the pressure control valve 64 in the second pipe line 54. In this case, the accumulator 63 is useful for quickly returning the second hydraulic cylinder 12 at a time when the second hydraulic cylinder 12 is expanded, and is essential for quickening SPM (a stroke number per one minute). Further, the accumulator 63 is useful for absorbing a shock of the oil in the side of the secondary port 44, in the case that the oil is transferred from the first hydraulic cylinder 11 to the second hydraulic cylinder 12 rapidly.

Further, in accordance with the hydraulic circuit on the basis of the present embodiment, when the pressure of the pressurized fluid applied to the second hydraulic cylinder 12 comes over the set value due to the contraction of the first hydraulic cylinder 11 caused by the pressing force of the inner slide 9, it is possible to discharge the pressurized fluid from the area (the consecutive passage 13) of the first and second hydraulic cylinders 11 and 12 on the basis of the actuation of the pressure control valve 59 so as to prevent the second hydraulic cylinder 12 and the drive portion 14 from being broken. Further, it is possible to increase a buffering capacity at a time when the second hydraulic cylinder 12 is expanded by the pressurized fluid supplied to the accumulator 63 from the secondary port 44 of the secondary hydraulic cylinder 12, it is possible to transmit the pressing force of the inner slide 9 to the outer slide 8 with no loss, and it is possible to return the first and second hydraulic cylinders 11 and 12 respectively to the expansion and contraction states at a time when the outer slide 8 and the inner slide 9 are returned to the top dead center.

Figure 7A:
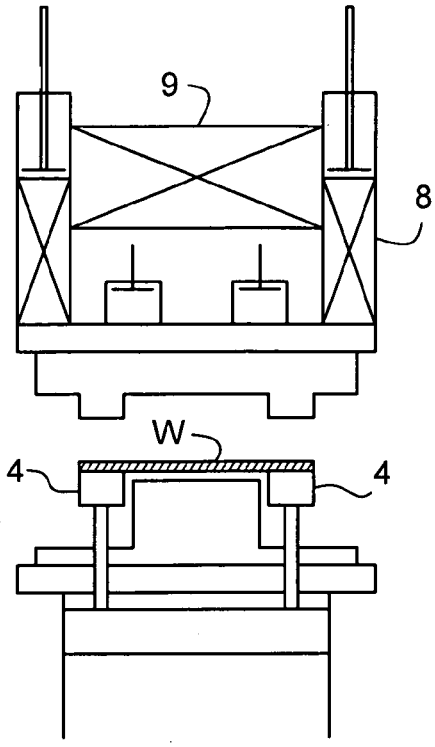
[FIGS. 7A–7D]
Figure 7B:
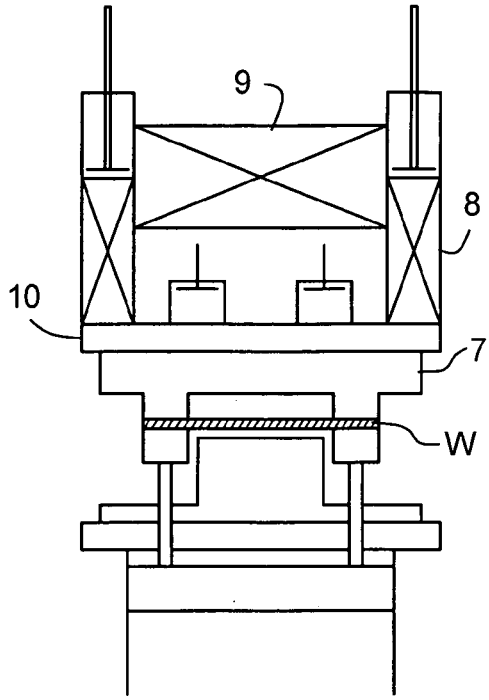
Figure 7C:
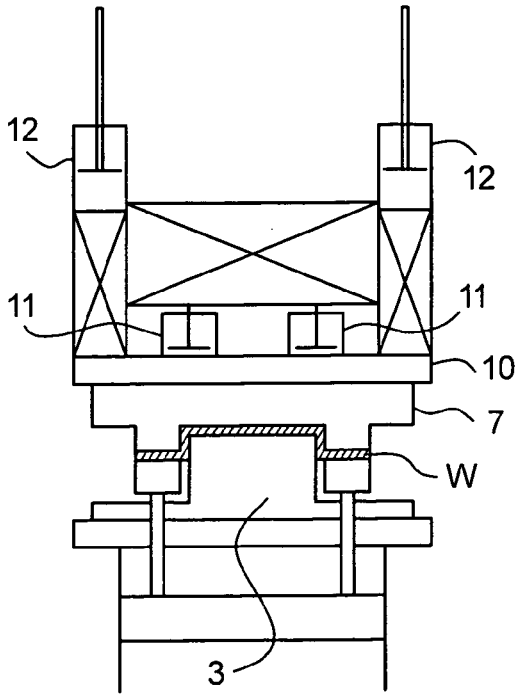
Figure 7D:
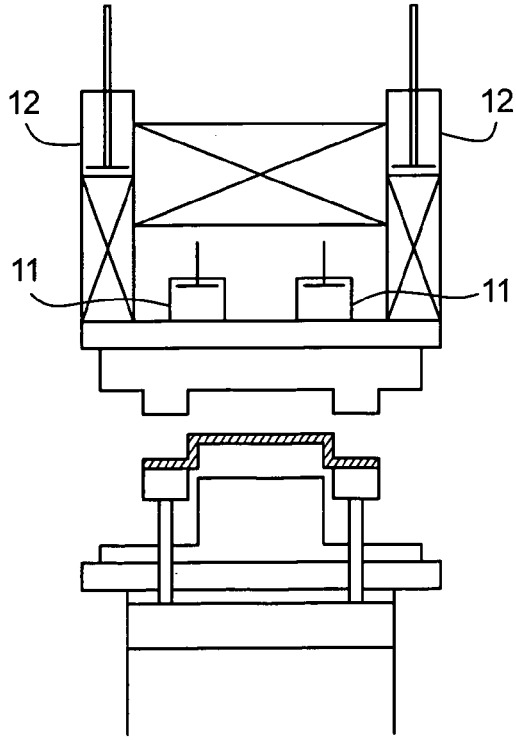

A description will be in detail given below of an operation using the embodiment of the mechanical press apparatus in accordance with the present invention structured as mentioned above, with reference to FIG. 7. FIG. 7 is a schematic view explaining a working operation of the blank W by the mechanical press apparatus shown in FIG. 1, in which FIG. 7(A) shows a state before being press molded, FIG. 7(B) shows a state in which the upper die 7 is moved downward so as to be brought into contact with the blank W, FIG. 7(C) shows a state of being press molded, and FIG. 7(D) shows a state after being press molded, respectively. First, in FIG. 7(A), the blank W is mounted on the blank holder 4, and the outer slide 8 and the inner slide 9 are at the top dead center and in a standby state. Further, the outer slide 8 and the inner slide 9 are moved downward as shown in FIG. 7(B) on the basis of the actuation of the drive portion 14 (refer to FIG. 1) from this state. In particular, the outer slide 8 is moved downward at a high speed prior to the inner slide 9, and when the peripheral edge portion of the upper die 7 is brought into contact with the blank W, the inner slide 9 is in the process of being moved downward at a position which is apart from the elevating plate 10. Accordingly, only the pressing force by the outer slide 8 is applied to the blank W via the elevating plate 10 and the upper die 7, and the outer slide 8 is at the substantial bottom dead center by the drive portion 14 at this time so as to await the downward movement of the inner slide 9.

Further, when the first hydraulic cylinder 11 is contracted by the pressing force caused by the downward movement of the inner slide 9 as shown in FIG. 7(C), the second hydraulic cylinder 12 is expanded by the effect of the pressure fluid pushed out from the first hydraulic cylinder 11, in specific, the cylinder barrel 12A (refer to FIG. 5) of the second hydraulic cylinder 12 is moved downward while pressing the outer slide 8 to the lower side, at the same time when the pressing force of the inner slide 9 is applied to the elevating plate 10 via the first hydraulic cylinder 11. Accordingly, the elevating plate 10 is pressed in the respective portions of the upper surface by the outer slide 8 and the inner slide 9 so as to be moved downward. As a result, it is possible to well press mold the blank W between the upper die 7 mounted to the lower surface of the elevating plate 10 and the lower die 3 on the bolster under a high pressure, while preventing the strain of the elevating plate 10.

When the press molding of the blank W is finished as mentioned above, the outer slide 8 and the inner slide 9 are returned to the initial position (the top dead center) as shown in FIG. 7(D), however, the second hydraulic cylinder 12 is returned to the contracted state by the pressurized fluid flowing out from the secondary port at this time, and the first hydraulic cylinder 11 is returned to the expanded state by the pressurized fluid discharged from the primary port.

Figure 8:
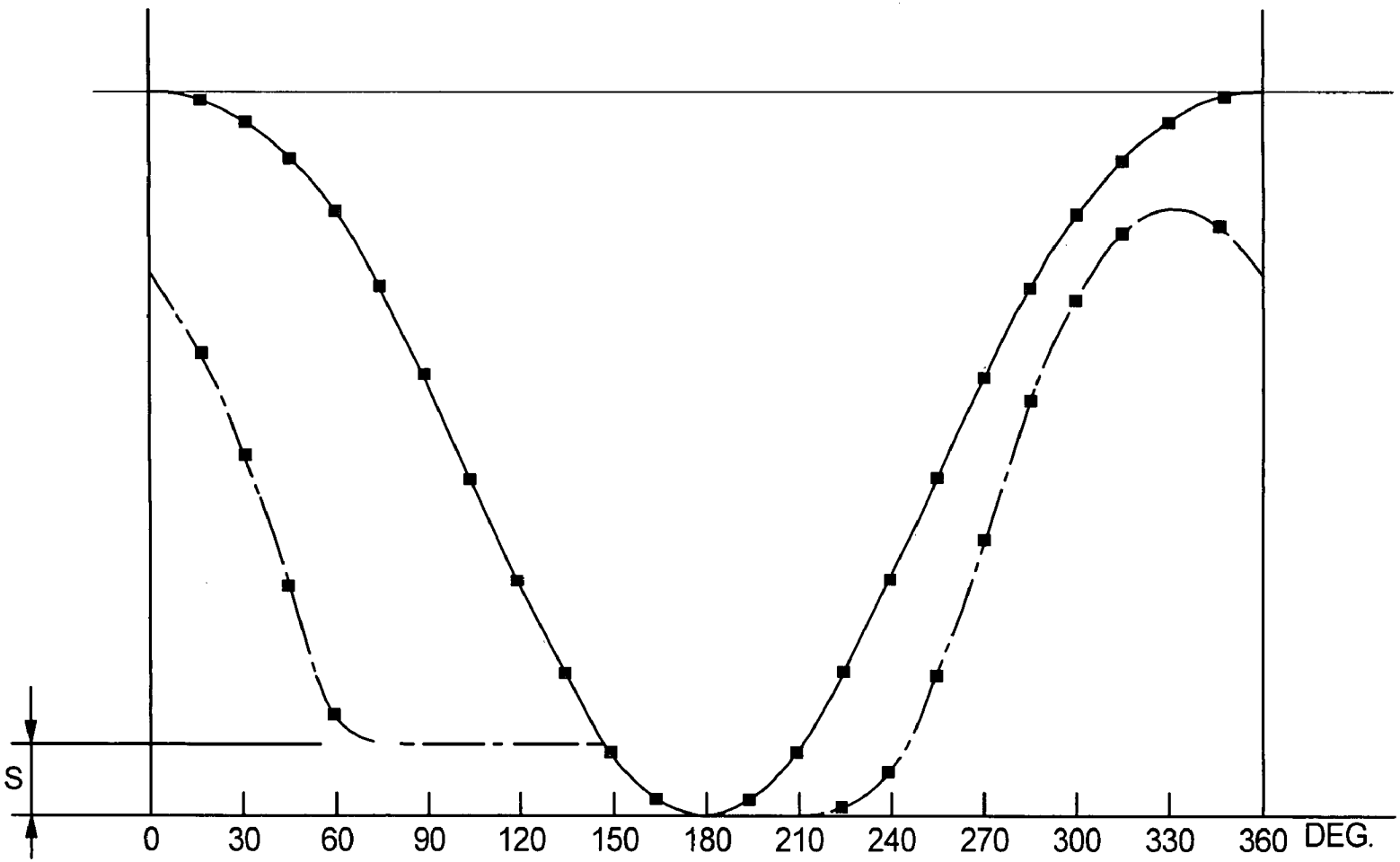
[FIG. 8]

In this case, FIG. 8 is a cycle curve of the outer slide 8 and the inner slide, in which a single-dot chain line shows a stroke of the outer slide 8 with respect to an angle of rotation (deg) of the crank shaft 19, and a solid line shows a stroke of the inner slide 9 in the same manner. As is apparent from the drawing, the outer slide 8 is moved downward prior to the inner slide 9, and is moved upward later than the inner slide 9. In particular, the outer slide 8 is temporarily stopped at the substantial bottom dead center while leaving an expansion stroke S of the second hydraulic cylinder 12, and is moved downward at the stroke S by being pressed by the second hydraulic cylinder 12 expanded as mentioned above, at a time when the inner slide 9 reaches the bottom dead center.

As mentioned above, in accordance with the mechanical press apparatus on the basis of the present invention, it is possible to apply the great pressing force by the outer slide 8 and the inner slide 9 to the respective portions on the upper surface of the elevating plate 10 fixed to the lower end surface of the outer slide 8, while being of the double action type in which the outer slide 8 and the inner slide 9 are independently driven, and it is possible to well press mold the blank W by the upper die 7 mounted to the lower surface of the elevating plate 10 while preventing the strain of the elevating plate 10.

The descriptions are in detail given above of the embodiments of the mechanical press apparatus in accordance with the present invention, however, the present invention is not limited to the embodiments, for example, the mechanical press apparatus mentioned above can be applied to a knuckle press, a link press, a friction press or the like without being limited to the crank press that the transmission mechanism of the drive portion 14 is the crank mechanism.

The invention claimed is:

1. A mechanical press apparatus provided with a drive portion which moves upward and downward an outer slide and an inner slide arranged in an inner side of the outer slide at a predetermined timing, characterized in that the mechanical press apparatus comprises:

an elevating plate fixed to a lower end surface of said outer slide so as to oppose to a lower surface of said inner slide;

an upper die (an upper mold) fixed to a lower surface of said elevating plate;

a lower die (a lower mold) positioned at a lower surface of an upward and downward movement of said upper die so as to press;

a first hydraulic cylinder provided in an upper surface portion of said elevating plate and contracted by a pressing force at a time when said inner slide moves downward; and a second hydraulic cylinder interposed between said outer slide and said drive portion and expanded working with a pressure of a pressurized fluid supplied from said first hydraulic cylinder at a time when said first hydraulic cylinder is contracted by the pressing force of said inner slide, thereby pressing said outer slide to a lower side.

2. A mechanical press apparatus as claimed in claim 1, characterized in that each of said first hydraulic cylinder and said second hydraulic cylinder is of a single rod type having an expansion rod integrally provided with a piston portion which is reciprocated in a longitudinal direction in an inner portion of a hollow and sealed cylinder barrel so as to expand and compress a fluid in an inner portion, and a rod portion which is extended from the piston portion to an outer portion of said cylinder barrel, and of a double action type having a primary port supplying and discharging the expanded and compressed fluid to a side of the piston portion of said expansion rod and a secondary port supplying and discharging the fluid in a side of the rod portion of said expansion rod in said cylinder barrel, and the cylinder barrels of the first hydraulic cylinder and the second hydraulic cylinder are connected in said primary ports to each other via a consecutive passage, and work with each other such that the pressurized fluid flows into said second hydraulic cylinder via said consecutive passage at a time when said first hydraulic cylinder is contracted, thereby expanding said expansion rod.

3. A mechanical press apparatus as claimed in claim 1 or 2, characterized in that a rate A1/A2 between a pressure receiving area A1 of said first hydraulic cylinder (the piston portion) and a pressure receiving area A2 of said second hydraulic cylinder (the piston portion) is set to be equal to a rate P1/P2 between a pressing capacity P1 of said inner slide and a pressing capacity P2 of said outer slide.

4. A mechanical press apparatus as claimed in claim 2, characterized in that a first pipe line for supplying the pressurized fluid having a predetermined pressure from a pressure source is connected to an area of said consecutive passage connecting the primary ports of said first hydraulic cylinder and said second hydraulic cylinder to each other, a second pipe line for supplying the pressurized fluid having a higher pressure than that of the pressurized fluid supplied to said first pipe line from said pressure source so as to return to said state before being communicated is connected to the secondary port of said second hydraulic cylinder, and the secondary port of said first hydraulic cylinder is provided so as to supply and discharge an air serving as the fluid in correspondence to said motion thereof.

5. A mechanical press apparatus as claimed in claim 2, characterized in that said first hydraulic cylinder is provided so as to be actuated only by said primary port with canceling said secondary port.

6. A mechanical press apparatus as claimed in claim 2, characterized in that an accumulator (a pressure accumulator) is provided in the secondary port of said second hydraulic cylinder.

7. A mechanical press apparatus as claimed in claim 1, characterized in that a die set portion for coupling said upper die is provided in the lower surface of said elevating plate.

8. A mechanical press apparatus as claimed in claim 4, characterized in that a check valve for preventing the pressurized fluid from flowing backward with respect to said pressure source, and a pressure control valve arranged in a downward side of said check valve are respectively interposed in said first pipe line and the second pipe line, and a working pressure of the pressure control valve in said first pipe line is set higher than that of the pressure control valve in said second pipe line.

* * * * *